United States Patent [19]

Mostosi

[11] 4,409,572

[45] Oct. 11, 1983

[54] ELECTRIC SWITCH

[75] Inventor: Angelo Mostosi, Bergamo, Italy

[73] Assignee: SACE S.p.A. Costruzioni Elettromeccaniche, Bergamo, Italy

[21] Appl. No.: 361,580

[22] Filed: Mar. 24, 1982

[30] Foreign Application Priority Data

Apr. 2, 1981 [IT] Italy ..... 21367/81[U]

[51] Int. Cl.[3] ..... H01H 75/00; H01H 77/00; H01H 83/00

[52] U.S. Cl. ..... 335/8; 335/201

[58] Field of Search ..... 335/8, 9, 10, 201, 202

[56] References Cited

U.S. PATENT DOCUMENTS 3,422,381 1/1969 Toth ..... 335/9

3,758,887 9/1973 Ellsworth et al. ..... 335/8

*Primary Examiner*—Harold Broome

*Attorney, Agent, or Firm*—Diller, Ramik & Wight

[57] ABSTRACT

An electric switch assembly is split into two mating units one of which contains the mechanical control component parts, the accessories and display means, the other unit containing the fixed contacts and the tripping means for the switch. Further seats can be provided to make arc-quenching chambers.

2 Claims, 1 Drawing Figure

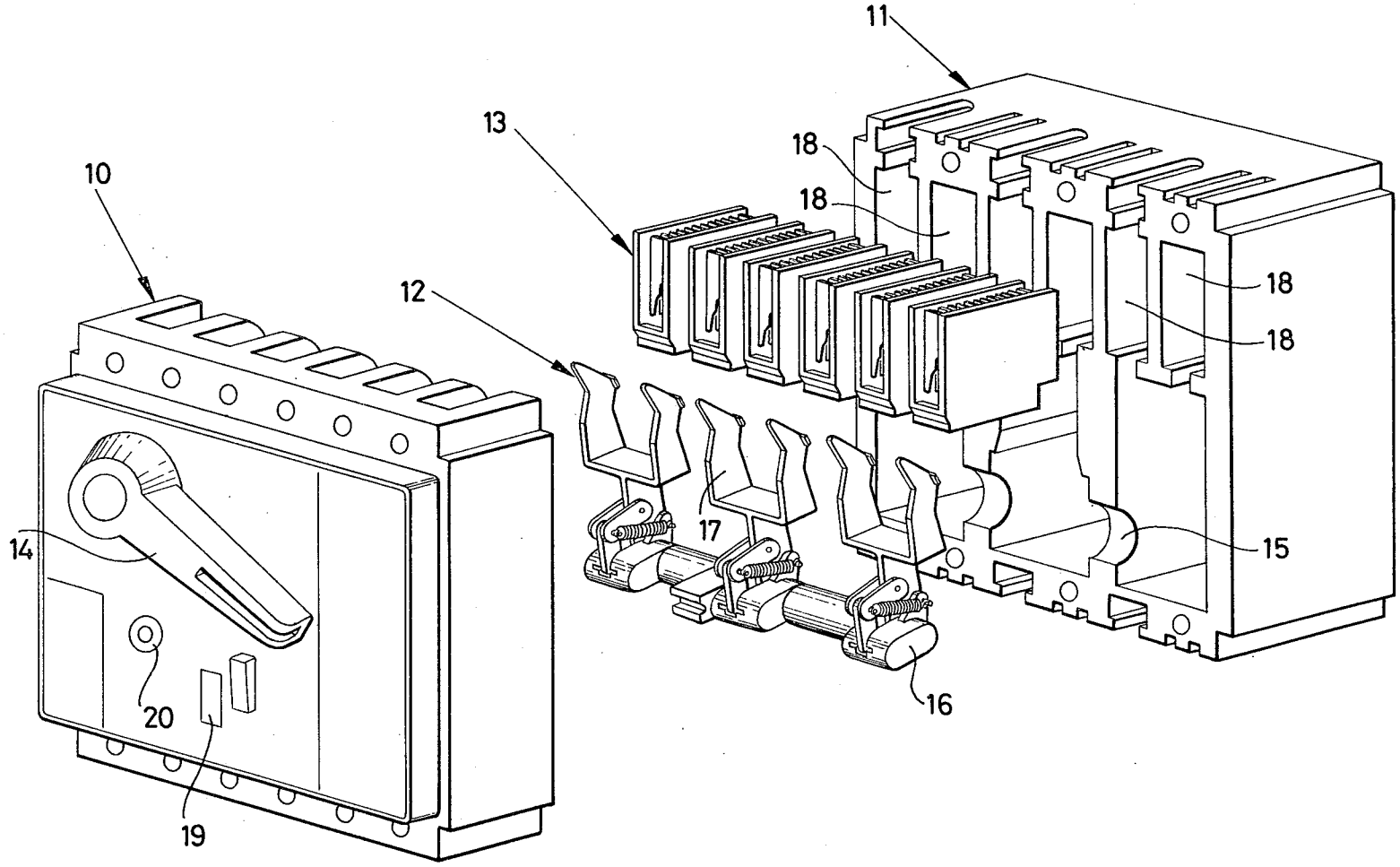
11
18
18
18
18
15
16
17
13
12
10
14
20
19

ELECTRIC SWITCH

This invention relates to an electric switch and refers, more particularly, to its arrangement of component parts.

It is known that an electric switch comprises, in addition to fixed and moving contacts, a control mechanism composed of a linkage connected to a handle for the manual control or to a solenoid for the remote control, as well as a device for the thermal and/or the magnetic trip of the switch. Usually, means are also provided for the visual and/or electric display of the condition of open or closed (OFF or ON) switch.

The control mechanism enables the movable contacts to selectively be brought to either position of opening or closure, whereas the tripping device enables the contacts to automatically be opened in the case of irregular operation, overloads and like failures.

In the electric switches constructed heretofore all the various component parts, both the mechanical and the electric ones, are housed within a single boxlike container having an appropriate lid to permit access to the internal component parts for upkeep and repair purposes.

Stated another way, a switch is always an entity which is prearranged for the specific uses for which it is intended and, if the requirements of service are changed, the usual solution is nothing but replacing the entire switch altogether. This fact not only involves, as it is apparent, not negligible costs for the user, but also, and above all, for the manufacturer and the seller of such switches, because they must prepare and keep in storage as many different switch types as the market requirements dictate, whereas the user cannot continue to use a certain switch if the service specifications change. Also the upkeep and replacement of component parts, whereever necessary, thus become very difficult and cumbersome.

An object of the present invention is to do away with these shortcomings by providing quite a particular arrangement of parts in an electric switch so as to provide a wide range of possible uses for different requirements without being compelled to replace a switch as a whole, while concurrently facilitating the upkeep operations and the replacement of individual items.

To achieve this object, it has been envisaged, according to the present invention, to compose an electric switch with two main constructional units which can be mated together and to secure with removable fastening means, either unit substantially containing all the mechanical control parts and optional accessories and display means, the other unit containing the fixed contacts and the thermal and/or magnetic tripping means, said two constructional units defining, in the correspondence with their mating areas, supporting seats for an independent moving contact unit which is latched in position as the two aforesaid constructional units are coupled to one another. The two main constructional units have, in correspondence with their mating areas, seats for housing the so-called arc-quenching chambers, these latter being provided as discrete units.

By such an arrangement of parts of the switch according to this invention, it becomes possible to variably combine the two main constructional units to fulfil the most varied service requirements. Thus, for instance, if only the switch calibration is to be modified, it suffices to replace the unit which contains the tripping devices and means, whereas the unit which contains the control and display means and the accessories may remain unaltered. Conversely, if it is desired, for a switch having a preselected calibration, to modify only the portion relating to the control and display means and the accessories, it suffices to change the relevant constructional unit. The advantages thus provided both to the user and the manufacturer and sales agent of the switch are now apparent: for the former, the main advantage lines in that the switch can be adapted to the most varied requirements without being compelled to purchase, every time, a new kind of switch, whereas, for the latter people, the advantage is that the number of switch types to be kept in storage to satisfy the several demandes of the customers can considerably be reduced. Furthermore, the upkeep and repair operations for the switches are considerably simplified, above all by virtue of the circumstance that the moving contact unit, which is exposed to the most intensive wear, can easily be replaced.

The electric switch according to this invention is diagrammatically shown in the single FIGURE of the accompanying drawing, wherein the switch is illustrated in an exploded perspective view.

As can be seen in the drawing, the switch consists of a first constructional unit 10, a second constructional unit 11, a moving-contact assembly 12 and arc-quenching chambers 13.

The constructional unit 10, which, as the switch is assembled, is situated frontally and acts like a lid, substantially comprises the entire control mechanism connected to a handle 14 which can be shifted from a position "O" (contacts open, OFF), to a position "I" (contacts closed, ON) and vice versa. In addition, on the unit 10 display means 19 and reacordal means 20 appear and the unit may also contain optional accessories. On the contrary, the second constructional unit 11, which, as the switch is assembled, is its bottom or box, and which is also called a "relay", contains the thermomagnetic tripping mechanisms, which are appropriately calibrated, as well as the fixed contacts of the switch with the attendant terminals for the connection to the mains.

Both in the unit 10 and the unit 11, in correspondence with the respective mating areas, half-seats are provided, such as 15 (they can be seen in the drawing) of the unit 11, which are adapted to receive the common arbor 16 which carries the moving contacts 17. This arbor 16 which, with its contacts 7 forms the moving contact unit 12, is inserted in the half-seats 15 and, after that the units 10 and 11 have been united together by means, such as screws and the like (not shown), it remains in its position without requiring any additional supporting and fastening means. It is apparent that, as the fastening means which keep the two units 10 and 11 united together are undone, the moving contact unit 12 can be withdrawn without any difficulty for inspection and replacement, if necessary. Also the fixed contacts which are in the unit 11 thus become readily acccessible for carrying out upkeep operations.

The two units, 10 and 11, additionally, are fitted, in their mutual mating areas, with seats, such as the seat 18 indicated for the unit 11, which are adapted to receive the arc-quenching chambers 13, which, with the two units mated together, are thus place roughly one half in one unit and one half in the second unit. Within said arc-quenching chambers 13 the moving contacts 17 are intended to be moved and their function is well known in the art.

Arc-quenching chambers mounted in this way, so as to form complementary units which are self-contained, become readily accessible for inspection and can be replaced if so required.

Usually, the section of a switch which is to be replaced most frequently if the service specifications are varied, is the relay section because it is previously calibrated for specific conditions of serivce, while the control section may be often used without alterations. Thus, the manufacturer and the sales agent of such switches will be mostly requested to keep available in storage a certain number of different types of the constructional units 11 whereas the other unit 10, which contains the mechanical control members may be standardized.

In addition, provision should be made to keep, as repair parts the moving contact units and the arc-quenching chambers available.

From what has been described in the foregoing, it is apparent that the arrangement of component parts as envisaged by this invention possesses a particular usefulness and convenience of use of the switches as compared with the conventional arrangements.

I claim:

1. An electric switch comprising two main constructional units defining a switch housing, a first of said units housing fixed contacts, associated terminals and tripping means; a second of said units carrying substantially the entire mechanical control mechanism of said electric switch including a manually operative handle movable between off and on positions, means carried by said second unit for displaying the electrical status of said electric switch, means for pivotal supporting movable contacts between opposing surface portions of each of said units whereby said movable contacts can be moved by the operation of said handle into and out of contact with said fixed contacts, said pivotal supporting means including an arbor carrying movable contacts, said arbor being confined by and seated relative to said opposing surface portions of said units, and means for removably fastening said units together to retain said arbor confined by and seated relative to said opposing surface portions.

2. The electric switch as defined in claim 1 including means for quenching electrical arc during switching movement of said movable contacts relative to said fixed contacts, and further opposing surface portions of each of said units collectively defining a housing for housing said arc quenching means.

* * * * *